US005138751A

United States Patent [19]

Shima et al.

[11] Patent Number: 5,138,751

[45] Date of Patent: Aug. 18, 1992

[54] BUCKLE

[75] Inventors: Yutaka Shima, Iwata; Ryukichi Murai, Toyama, both of Japan

[73] Assignee: Yoshida Koygo K. K., Tokyo, Japan

[21] Appl. No.: 813,644

[22] Filed: Dec. 27, 1991

[30] Foreign Application Priority Data

Dec. 28, 1990 [JP] Japan ..... 2-405629

[51] Int. Cl.[5] ..... A44B 11/25

[52] U.S. Cl. ..... 24/637; 24/656; 24/658

[58] Field of Search ..... 24/637, 638, 639, 640, 24/641, 642, 651, 652, 656, 657, 658, 633

[56] References Cited

U.S. PATENT DOCUMENTS 3,921,262 11/1975 Tanaka ..... 24/637
4,060,879 12/1977 Takada ..... 24/637
4,310,953 1/1982 Nanasi ..... 24/656
4,457,052 7/1984 Hauber ..... 24/656
4,660,260 4/1987 Ishiguro ..... 24/637
4,715,096 12/1987 Fleming et al. ..... 24/641

*Primary Examiner*—Victor N. Sakran
*Attorney, Agent, or Firm*—Hill, Van Santen, Steadman & Simpson

[57] ABSTRACT

A buckle for connecting opposite ends of a belt or the like is disclosed. the buckle comprises a plug member and a socket member releasably engageable therewith. The socket member has a central through-opening for accommodating a locking member and a spring member which has a plurality of integrally formed strip-like spring elements arranged to provide uniform distribution of pressure over the locking member.

4 Claims, 7 Drawing Sheets

BUCKLE

BACKGROUND OF THE INVENTION

1. Field of the Invention

This invention relates to improvements in and relating to buckles for connecting respective ends of straps or belts and more particularly to a so-called center-release type buckle which has wide application to automobile safety belts, helmets and the like.

2. Prior Art

There are known numerous center-release type buckles, a typical example of which comprises a plug member, a socket member releasably engageable therewith and a locking member resiliently supported in the socket member and adapted to be depressed to separate the plug member from the socket member. More specifically, as disclosed in Japanese Utility Model Application No. 51-9381, the locking member is vertically movably supported on a compression spring accommodated in a window formed in the upper surface of the socket member and is guided by a guide plate inserted in place through a slot in the socket member. When assembling the socket member, the compression spring and the locking member are placed from above into the window, followed by inserting the guide plate horizontally through the slot into the socket member while somewhat depressing the locking member against the tension of the compression spring. This two directional assembling process is literally time-consuming and tedious. Such a prior art buckle has a further drawback in that since the locking member is supported at a point on the compression spring, it is prone to tilt and get stuck or caught at the peripheral wall of the window unless caution is exercised so as to apply a pressure uniformly over the entire surface of the locking member when releasing the plug from the socket.

SUMMARY OF THE INVENTION

With the foregoing drawbacks of the prior art buckles, the present invention seeks to provide an improved buckle which is capable of expeditious assembling and which is reliable in operation.

The above and other objects and features will be better understood from the following detailed description taken upon reference to the accompanying drawings. Like or corresponding reference numerals refer to like parts throughout the several views of the drawings.

According to the invention, there is provided a buckle which comprises: a plug member having a engaging tongue with a locking aperture; a socket member releasably engageable with the plug member and having a central through-opening, an elongate guide slot for receiving the tongue and a plurality of hook-receiving apertures; a locking member dimensioned to fit in the through-opening and having a locking prong engageable with the locking aperture; and a spring member having a base plate provided with a plurality of hooks for engagement with the hook-receiving apertures and a plurality of spring elements formed integrally with the base plate and protruding alternately in opposite directions such that adjacent elements assume a substantially "X"-shaped cross-section, the spring elements being disposed to normally urge the locking member upwardly within the through-opening.

DETAILED DESCRIPTION OF THE INVENTION

Figure 1:
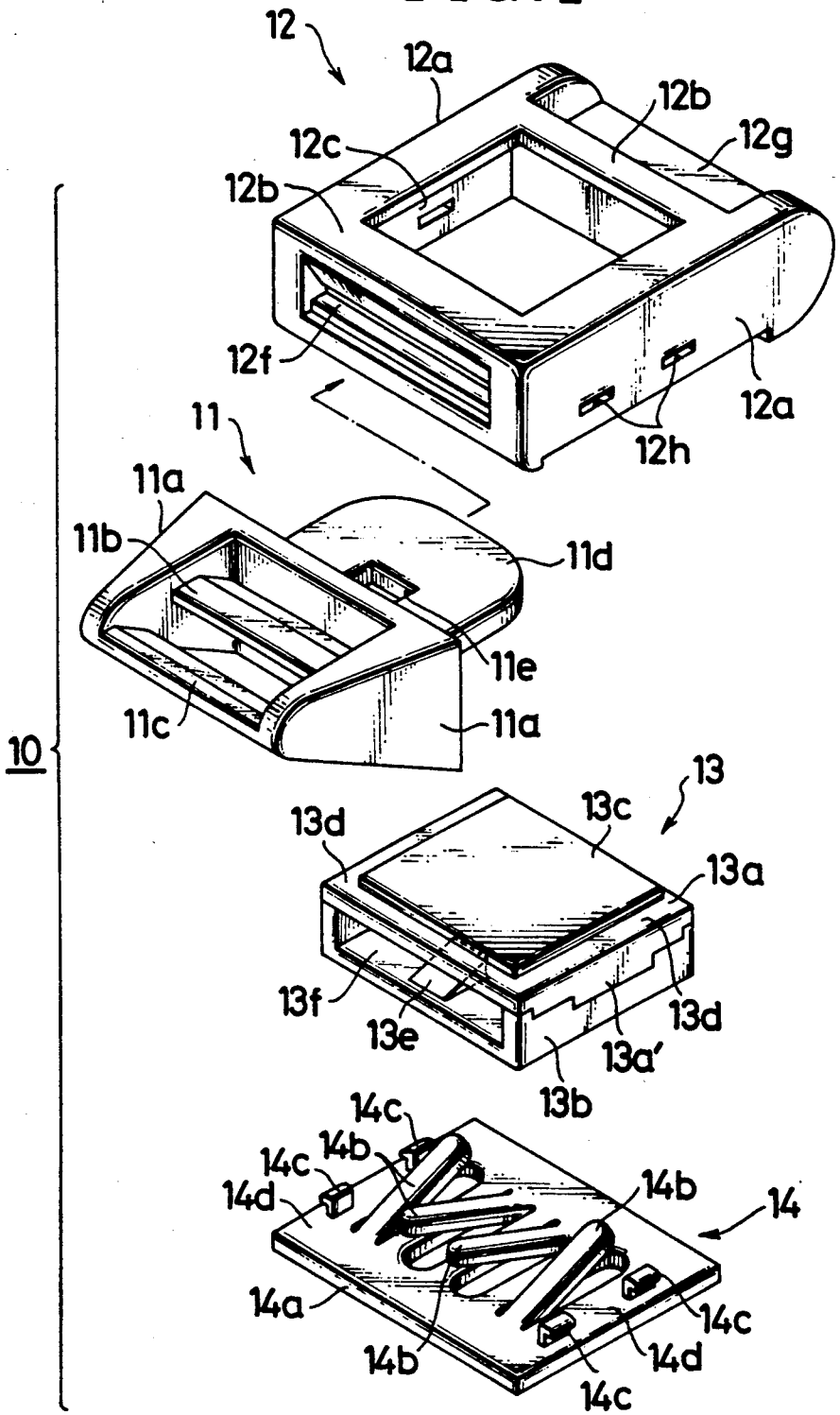
FIG. 1 is an exploded perspective view of a buckle embodying the invention.
Figure 2:
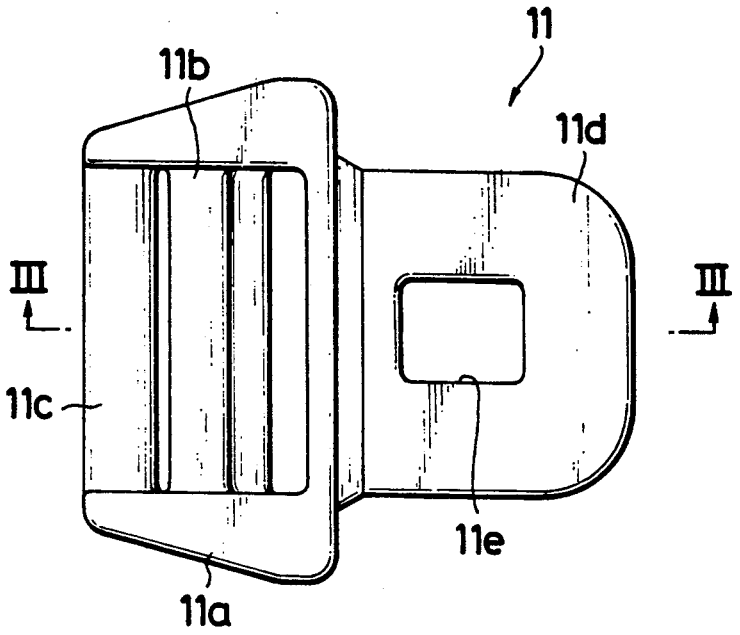
FIG. 2 is a plan view of a plug member constituting one part of the buckle.
Figure 3:
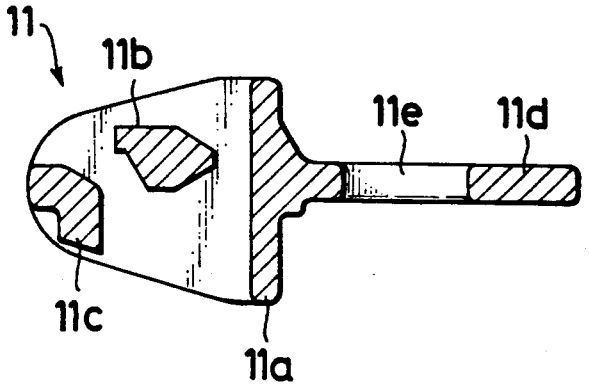
FIG. 3 is a longitudinal cross-sectional view taken on the line III—III of FIG. 2.
Figure 4:
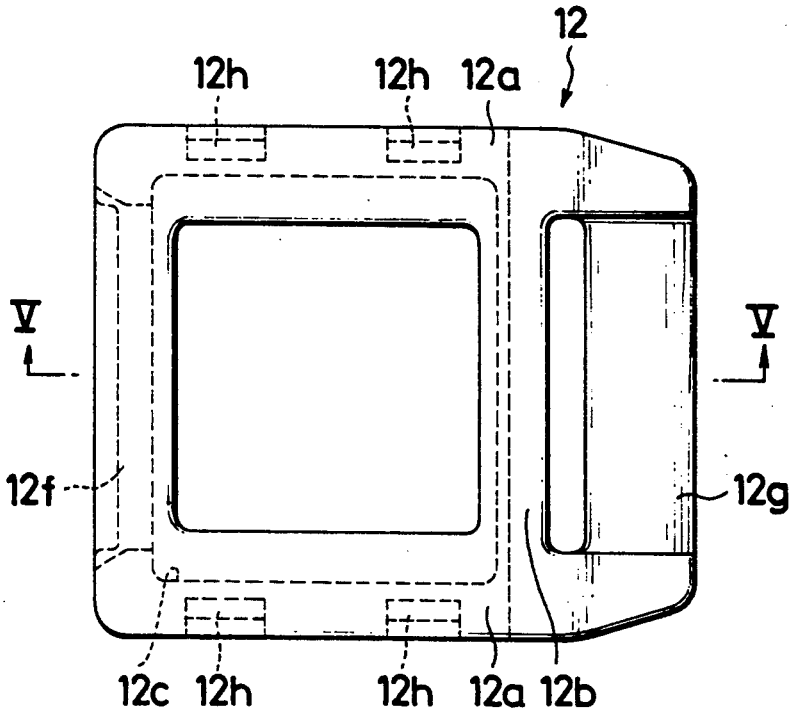
FIG. 4 is a plan view of a socket member constituting another part of the buckle.
Figure 5:
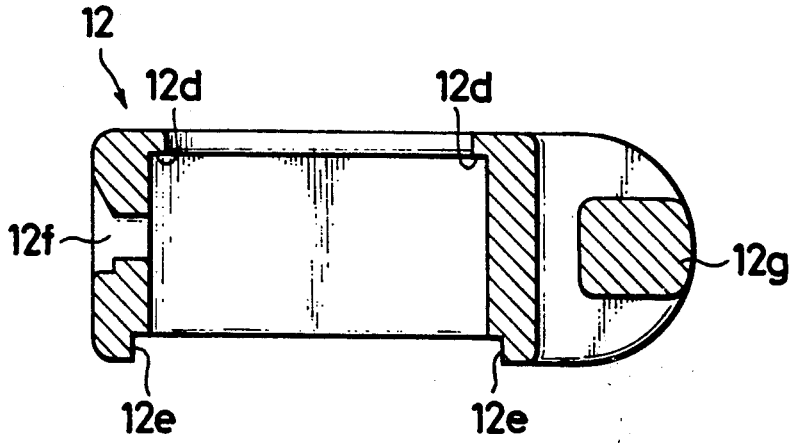
FIG. 5 is a longitudinal cross-sectional view taken on the line V—V of FIG. 4.

Referring now to the drawings and FIG. 1 in particular, there is shown a buckle 10 which comprises a plug member 11 and a socket member 12 releasably engageable therewith.

Figure 8:
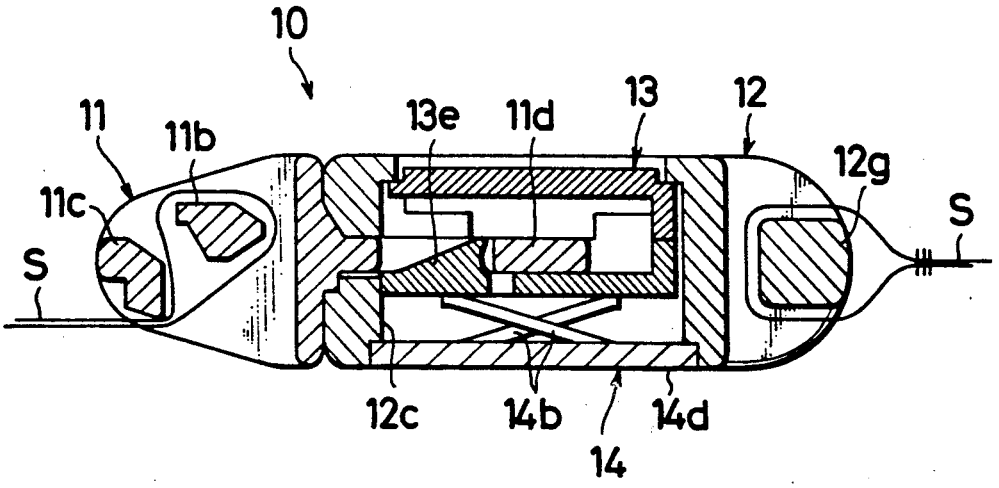
FIG. 8 is a central longitudinal cross-sectional view of the buckle shown assembled.

The plug member 11 has parallel spaced side flanges 11*a*, 11*a*, a strap guide cross bar 11*b*, a strap retaining cross bar 11*c* both extending in parallel transversely between the side flanges 11*a*, 11*a*, and an engaging tongue 11*d* having a locking aperture 11*e* and releasably engageable with the socket member 12 in a manner hereinafter to be described. One end of a strap S is passed around the guide cross bar 11*b* and retained in place underneath the retaining cross bar 11*c* in a manner well known as illustrated in FIG. 8. The plug member 11 is fabricated from a suitable metallic material but may be of other materials.

Figure 9:
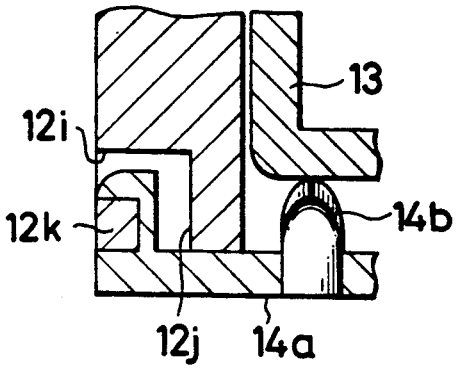
FIG. 9 is a cross-sectional view of a portion of the socket member.

The socket member 12 generally rectangular in shape made from a plastics material such as polyacetal has parallel side flanges 12*a*, 12*a* and parallel end flanges 12*b*, 12*b* defining therebetween a square or rectangular central through-opening 12*c* which is peripherally recessed to provide a first retaining rim 12*d* immediately beneath the upper surface of the socket member 12. The lower surfaces of the side flanges 12*a*, 12*a* of the socket member 12 are recessed to provide a second retaining rim 12*e*. An elongate guide slot 12*f* is formed in the front end of the socket member 12 for receiving the engaging tongue 11*d* of the plug member 11. At the rear end of the socket member 12 is formed a strap fastening cross bar 12*g* for passing therearound the opposite end of the strap S in a manner well known as illustrated in FIG. 8. A plurality of hook-receiving apertures 12*h* are formed in the side flanges 12*a*, 12*a* of the socket member 12 and each have a cross-sectionally inverted "L" shape defined by a horizontal inner wall portion 12*i*, a vertical inner wall portion 12*j* and a hook-supporting block wall portion 12*k* as better shown in FIG. 9.

Figure 6:
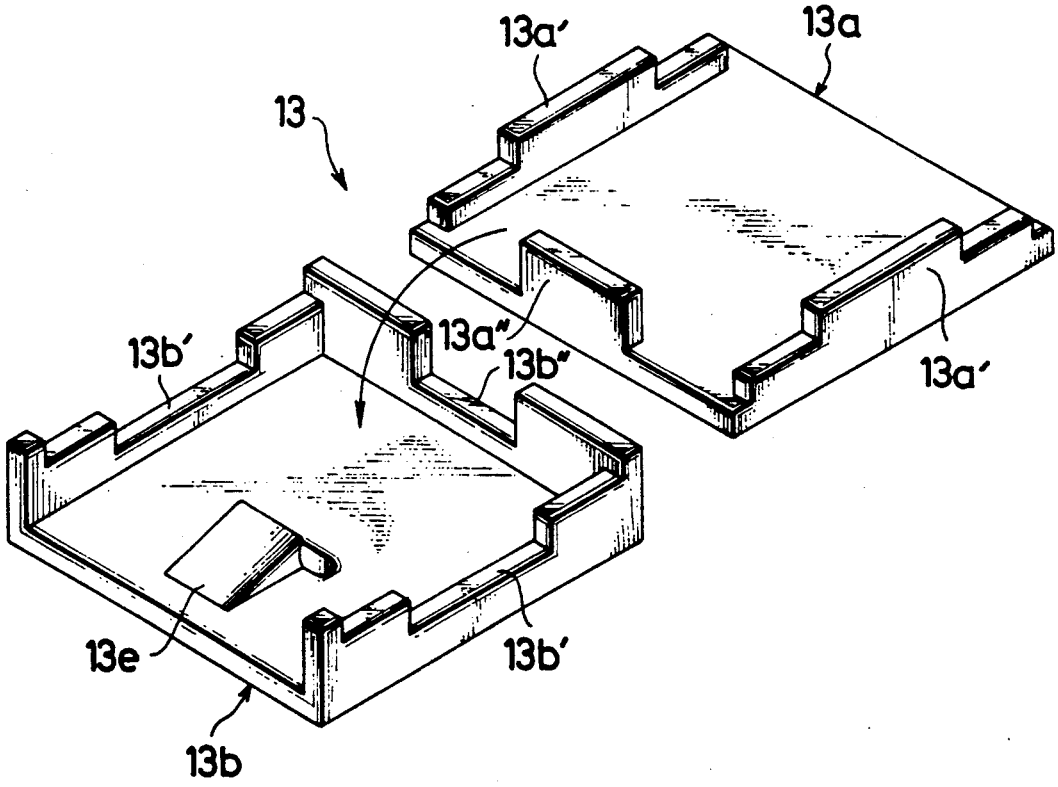
FIG. 6 is an exploded perspective view of a locking member forming part of socket member.
Figure 7:
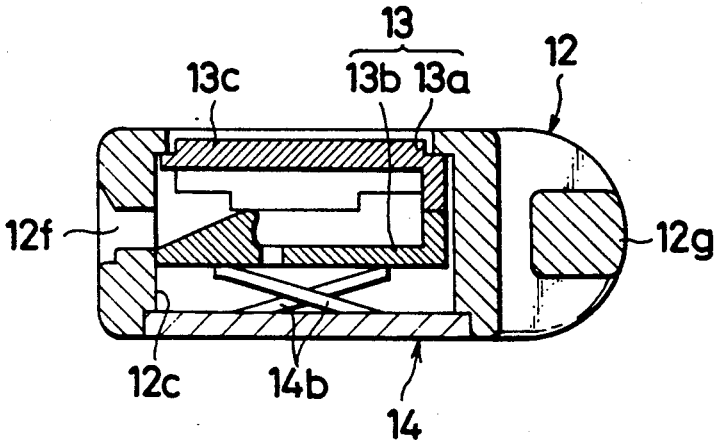
FIG. 7 is a central longitudinal cross-sectional view of the socket member shown assembled.

The buckle 10 according to the invention further includes a locking member 13 which is formed into a generally rectangular box. As better shown in FIG. 6, the locking member 13 is formed from two interengaging male and female parts 13*a* and 13*b*. The male part 13*a* has side ridges 13*a'*, 13*a'* for fitting engagement with corresponding side grooves 13*b'*, 13*b'* formed in the side walls of the female part 13*b* and an end ridge 13*a''* for fitting engagement with corresponding end groove 13*b''* formed in the rear end of the female part 13*b*. The male part 13*a* is made from a plastics material and the female part 13*b* is made from a material similar to or different from that of the plug member 11. The male part 13*a* further includes a rectangular manipulating tab 13*c* raised above its upper surface and dimensioned to leave a contiguous peripheral land 13*d* for abutting engagement with the first retaining rim 12*d* of the socket member 12 when the buckle is assembled as shown in FIGS. 7 and 8. A locking prong 13*e* is formed centrally on the female part 13*b* adjacent to an open end 13*e* of the locking member 13 remote from the end groove 13*b''*. The male and female parts 13*a*, 13*b* of the locking member 13 when joined together provides a rectangular guide channel 13*f* which is disposed for communication with the guide slot 12*f* of the socket member 12 to receive therethrough the tongue 11*d* of the plug member 11.

Designated at 14 is a spring member which also constitutes part of the socket member 12. The spring member 14 is formed from a material similar to that of the locking member 13 into a rectangular base plate 14*a* having a plurality of strip-like spring elements 14*b* struck out integrally therefrom to protrude alternately in opposite directions such that adjacent elements 14*b* assume a substantially "X" profile as better shown in FIGS. 7 and 8. The spring elements 14*b* are thus arranged symmetrically in a row such that their urging pressure is uniformly distributed over the entire locking member 13 when the spring member 14 is joined together with the locking member 12. The spring member 14 includes a plurality of hooks 14*c* formed adjacent to opposite side edges of the plate 14*a*, leaving side marginal surface portions 14*d* for abutting engagement with the second retaining rim 12*e* of the socket member 12.

Assembling of the socket component parts above described is performed by first inserting the locking member 13 through the central opening 12*c* from the bottom end thereof into the body of the socket member 12, when the locking member 13 is snugly received in the opening 12*c* with the peripheral land portion 13*d* held in abutting engagement with the first retaining rim 12*d*, in which instance only the manipulating tab 13*c* of the locking member 13 is exposed to view.

This is followed by joining the spring member 14 with the socket member 12, in which instance the hooks 14*c* of the spring member 14 are inserted through the hook-receiving apertures 12*h* and retained in place on the hook-supporting block wall portions 12*k*, with the spring elements 14*b* held in abutting engagement with the lower surface of the locking member 13. In this position, the locking member 13 is stably held in place under the influence of upwardly directed resilient forces of the spring elements 14*b*. Thus, the socket member 12 is assembled with its associated locking member 13 and spring member 14 with ease and accuracy because these associated members are arranged to be put in place unidirectionally from the bottom end of the socket member 12.

In use of the buckle 10, the plug member 11 is coupled with the socket member 12 by inserting the tongue 11*d* through the guide slot 12*f* into the guide channel 13*f* against the tension of the spring member 14 until the looking aperture 11*e* of the tongue 11*d* becomes engaged with the locking prong 13*e* of the locking member 13. The plug member 11 is released from the socket member 12 by pressing the manipulating tab 13*c* integral with the locking member 13 against the tension of the spring member 14 so as to disengage the tongue 14*d* from the locking prong 13*e*. In this instance, the individual spring elements 14*b* arranged in a substantially cross-sectionally "X"-shaped array (FIGS. 7 and 8) are depressed and brought progressively into sliding contact with the lower surface of the locking member 13, so as to afford to uniform distribution of pressure over the entire locking member 13 to permit the latter to descend substantially along a straight vertical path when releasing the plug 11 from the socket 12, thereby eliminating the tendency of the locking member 13 otherwise tilting and jamming against the interior walls of the socket member 12.

Figure 10:
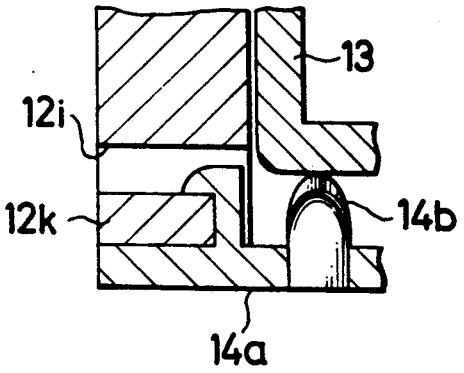
FIG. 10 is a view similar to FIG. 9 but showing a modified portion of the socket member in inoperative position.
Figure 11:
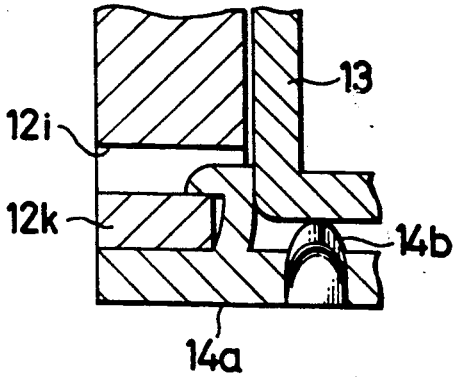
FIG. 11 is a view similar to FIG. 10 but showing the modified portion in operative position.

FIGS. 10 and 11 show a modified arrangement in which the vertical inner wall portions 12*j* of the socket member 12 is removed so that the hooks 14*c* of the spring member 14 is disposed for abutting engagement with the locking member 13, when the tab 13*c* is depressed to lower the locking member 13, so as to prevent the hook 14*c* from becoming deformed and disengaged from the supporting block wall 12*k* of the socket member 12.

Figure 12:
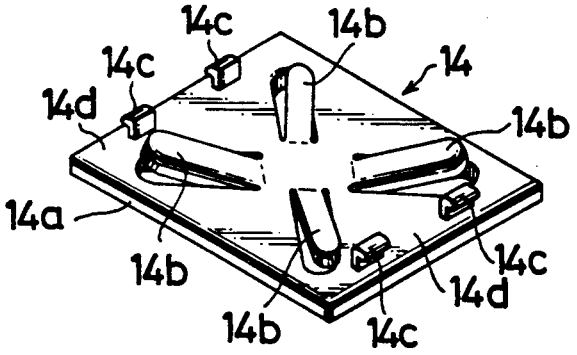
FIG. 12 is a view similar to a perspective view of a spring member included in the buckle shown in FIG. 1.

FIG. 12 shows a modified form of spring member 14 in which the spring elements 14*b* are arranged to extend diagonally across the rectangular base plate 14*a*.

Obviously, various modifications and variations of the present invention are possible in the light of the above teaching. It is therefore to be understood that within the scope of the appended claims the invention may be practiced otherwise than as specifically described.

As for an example, a modification may be made such that the locking prong 13*e* is formed integral with the plug member 11 for locking engagement with the socket member 11.

What is claimed is:

1. A buckle which comprises:

(1) a plug member having an engaging tongue;

(2) a socket member releasably engageable with said plug member and having a central through-opening, an elongate guide slot for receiving said tongue and a plurality of hook-receiving apertures;

(3) a locking member dimensioned to fit in said through-opening and engageable with said plug member; and (4) a spring member having a base plate provided with a plurality of hooks for engagement with said hook-receiving apertures and a plurality of spring elements formed integrally with said base plate and protruding alternately in opposite directions such that adjacent elements assume a substantially "X"-shaped cross-section, said spring elements being disposed to normally urge said locking member upwardly within said through-opening.

2. A buckle as defined in claim 1 wherein said locking member further includes a manipulating tab exposed to view through said through-opening for depressing said locking member to descend against the tension of said spring 3. A buckle as defined in claim 1 wherein said spring elements are arranged symmetrically in a row to provide uniform distribution of pressure over said locking member.

4. A buckle as defined in claim 1 wherein said hooks are disposed for abutting engagement with said locking member when the latter descends.

* * * * *